United States Patent [19]

Bowen

[11] 4,245,428

[45] Jan. 20, 1981

[54] HAND-CONTROLLED PUPPET

[76] Inventor: Anita L. Bowen, 250 Old Mill Rd., Santa Barbara, Calif. 93110

[21] Appl. No.: 61,997

[22] Filed: Jul. 30, 1979

[51] Int. Cl.[3] ..... A63H 7/00; A63H 3/30; A63H 13/16

[52] U.S. Cl. ..... 42/126; 46/145; 156/61; 156/70; 156/93

[58] Field of Search ..... 46/154, 126, 145, 146; 156/61, 70, 93

[56] References Cited

U.S. PATENT DOCUMENTS

| | | | |
|---|---|---|---|
| 555,740 | 3/1896 | Scaife | 46/146 X |
| 3,471,966 | 10/1969 | Kratzer | 46/154 |
| 3,698,127 | 10/1972 | Harp | 46/126 |
| 3,763,591 | 10/1973 | Fontana | 46/145 |

FOREIGN PATENT DOCUMENTS

| | | | |
|---|---|---|---|
| 1301966 | 8/1969 | Fed. Rep. of Germany | 46/145 |

*Primary Examiner*—F. Barry Shay
*Attorney, Agent, or Firm*—Daniel J. Meaney, Jr.

[57] ABSTRACT

A hand-controlled puppet having a conical-shaped support member which includes a hollowed-out central area and a thin wall and which terminates in a small aperture at the tip and in a large aperture at the base of the conical-shaped support member wherein the apertures and hollowed-out central area of the cone are in axial alignment; an elongated rod which extends axially through the hollowed-out central area and past and beyond the small aperture at the tip and past and beyond the large aperture at the base and which is adapted to be moved vertically and to be rotated in a clockwise and counterclockwise direction in any vertical position; a simulated puppet head mounted on the base end of the elongated rod; a bilaminar covering having a back and front and a pair of opposed extending arms which are adapted to have the elongated rod extend therebetween and wherein an elongated back portion and the interior of the back and front of the bilaminar covering as well as the head are adhered to the elongated rod extending through the bilaminar covering, wherein a user can hold the conical-shaped support member in one hand and move the elongated rod with the other hand to draw the head and bilaminar covering into the hollowed-out central area of the conical-shaped support member to close the puppet and to transport the head and the bilaminar covering from the hollowed-out area to open the puppet and to rotate the extended rod through limited directions of rotation and in either a clockwise or counterclockwise direction to animate the puppet, is shown.

15 Claims, 10 Drawing Figures

HAND-CONTROLLED PUPPET

BACKGROUND OF THE INVENTION

1. Field of the Invention.

This invention relates to a hand-controlled puppet, and more particularly, to a hand-controlled animated puppet which is adapted to be manipulated by a user by withdrawing the head and bilaminar covering forming a puppet body into the interior of a conical-shaped support member, such as a cone, into a closed position and to transport the head and bilaminar covering out of the cone into an open position and to cause movement of the arms and body relative to the head and cone by moving and rotating an elongated rod clockwise and counterclockwise to simulate lifelike movement of the puppet.

In addition, a method for assembling a hand-controlled animated puppet, is disclosed herein.

2. It is known in the prior art to form a manipulatory puppet comprising a conical-shaped member, a unitary piece of fabric having a symmetrical shape in the back and front and opposed arms extending therefrom and an elongated rod affixed to a simulated head wherein the puppet head can be turned around its axis once or even several times in any position and the complete turning of the head is accomplished without any simultaneous turning of or movement of the arms. Such a manipulatory puppet is shown in U.S. Pat. No. 3,471,966.

The use of a support member and elongated rod having a head affixed thereto to simulate movement of the head on the exterior of the support, are known in the art. Typical examples of such puppets and dolls are disclosed in U.S. Pat. Nos. 3,698,127 and 2,429,928.

Other known hand-controlled puppets are fabricated to slip over the hand of a user and permit the user's fingers to be inserted into the puppet's arms such that finger movement causes the arms of the puppet to be moved to animate the puppet.

The present invention discloses a unique and novel hand-controlled puppet which comprises a conical-shaped support member which is held in the hand of a user and an animated puppet which is formed of a simulated head attached to the end of an elongated rod and a unique and novel bilaminar covering having a back and front which defines a pair of opposing arms. The extended rod and head are affixed to an extended portion of the back of the bilaminar covering and to the interior of the back and front of the bilaminar covering to simulate a backbone. Rotation of the elongated rod in either a clockwise or counterclockwise direction rotates the top, front and back portions of the bilaminar covering relative to the fixed portion of the bilaminar covering attached to the base of the conical-shaped support member to cause relative rotation therebetween which moves the arms in an upward and downward position. The puppet can be rotated to cause movements of the arms simultaneously with rotation of the head. The puppet can be moved into a closed position by pulling the head into the interior of the conical-shaped support member.

The hand-controlled animated puppet can be formed to represent a number of figures such as, for example, bears, mice, ducks or the like. The fabrication of the hand-controlled puppet can use a wide variety of materials, shapes and forms as the bilaminar covering including materials which have a fur-like exterior or a smooth exterior. The use of the hand-controlled puppet provides children and adults with a unique and novel play toy wherein the puppet simulates lifelike movement of the head and arms which can be produced by movements and rotation of the rod either clockwise or counterclockwise and positioning the elongated rod in any number of different and vertical positions to obtain different types of movements and gestures.

The unique and novel hand-controlled puppet of the present invention differs substantially over the known prior art devices. The known prior art devices permit movement, turning or rotation of the head relative to a rigid support member which forms the body of a puppet, or a fabric material which forms the body, without simultaneous movement of the arms. In the known prior art hand-controlled puppets, where a user's fingers are inserted into the arms, the user must have sufficient finger dexterity or control to move the arms of the puppet.

The present invention permits rotation of the head and simultaneous turning and movement of the arms relative to the head such that animated movement of the puppet occurs. The primary difference of the present invention and the known prior art devices resides in the attachment of the top portion of a bilaminar covering to the back of the head and the attachment of the interior of the back and front of the bilaminar covering to the elongated rod to form a simulated backbone and in the relative rotation which occurs between the bottom of the bilaminar covering attached to the conical-shaped support member and the top attached to the head and elongated rod assembly which move the opposed extending arms simultaneously with limited rotation of the elongated rod.

One advantage of the present invention is that the hand-controlled puppet can be completely withdrawn into the interior of the conical-shaped support member, and, in the preferred embodiment, a hat member serves as a cover therefor.

Another advantage of the present invention is that the puppet can be held in one hand of a user and the other hand can be used for movement of the elongated rod in the vertical direction and/or in a clockwise or counterclockwise direction to produce an animated movement of the puppet wherein extended opposing arms are moved relative to the head and base in a lifelike movement.

Yet another advantage of the present invention is that the puppet can be transported out of the cone and into view in an open position by moving the elongated rod in a vertical direction and movement of the arms can be simultaneously obtained by rotating the rod.

A further advantage of the present invention is that the degree of rotation of the puppet is limited by the physical relationship of the assembled puppet in a manner to produce animated movement of the puppet during a limited amount of rotation of the head by the elongated rod.

A still further advantage of the present invention is that the puppet, when in a closed position, has the entire bilaminar covering and head contained within the hollowed-out central area of the conical-shaped support member and has a top which is affixed to the head, positioned over the opening in the base to show a completely closed puppet. The puppet is opened by transporting the head and bilaminar fabric from the interior of the conical-shaped support member into a position where the head and bilaminar covering are extended therefrom and the top affixed to the head is moved away from the base.

Yet a still further advantage of the present invention is that the conical-shaped support member can be formed of a cloth material such that the cone is pliable and can be easily shipped without breaking.

BRIEF DESCRIPTION OF THE DRAWING

These and other advantages of the invention, together with its various features and advantages, can be more easily understood from the following detailed description taken in conjunction with the accompanying drawing in which.

DESCRIPTION OF THE PREFERRED EMBODIMENT

Figure 1:
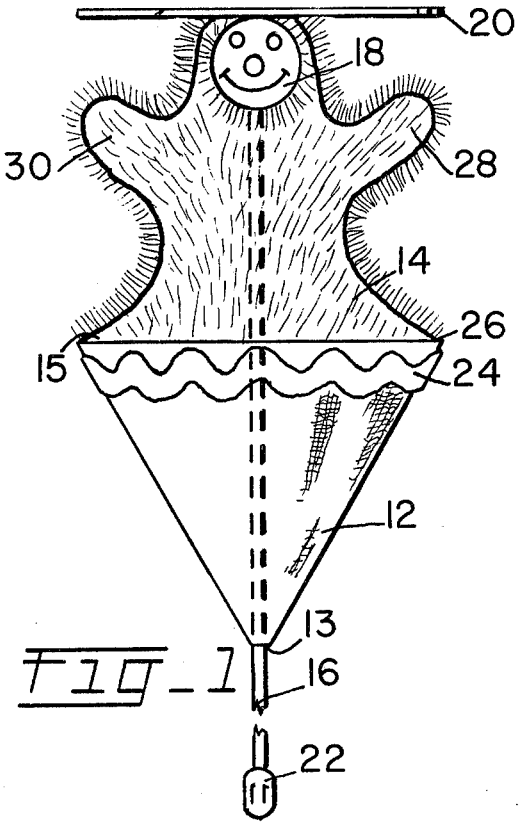
FIG. 1 is a front view of a hand-controlled animated puppet in an open position.

The hand-controlled puppet illustrated in FIG. 1 includes a conical-shaped support member 12 having a hollowed-out central area which terminates in a first aperture 13 at the tip end of the conical-shaped support member 12 and a second aperture 15 at the base end of the conical-shaped member 12. Both apertures 13 and 15 are in axial alignment with the axis of the conical-shaped support member and with the center of each other. The conical-shaped member 12 has a thin side wall construction.

An elongated rod 16 is positioned in the hollowed-out central area of the conical-shaped support member 12. Rod 16 extends axially through and beyond the first aperture 16 and terminates in an annular-shaped ball member 22. Similarly, the elongated rod 16 extends past and beyond the second aperture 15 at the base of the conical-shaped support member 12. The elongated rod 16 is adapted to move vertically along the axis of the conical-shaped support member and through the first aperture 13 and the second aperture 15. Also, elongated rod 16 is adapted to be rotated in a clockwise and counterclockwise direction in any vertical position.

The simulated puppet head 18 is mounted on the end of the elongated rod 16 adjacent to the second aperture 15.

A bilaminar covering, generally designated as 14, has a back and front section and a bottom portion. The bilaminar covering 14 is adapted to be positioned adjacent the second aperture 15 and is adapted to have the portion of elongated rod 16 which extends past beyond the base and aperture 15 located in the back and front thereof. The bilaminar covering 14 is affixed to the back of the simulated head 18. Likewise, the bottom of bilaminar covering 14 is attached to the base of the conical-shaped support member 12 at the large aperture 15. In addition, the bilaminar covering 14 defines a pair of opposed extending arm 28 and 30 as shown in FIG. 1.

A planar-shaped member having a geometrical dimension which is substantially equal to the dimension of the second aperture 15 and the base of the conical-shaped support member 12, such as, for example, a large hat-like member 20, may be attached to the top of the head 18 as shown in FIG. 1. Thus, when the hand-controlled puppet is in the opened position, the bilaminar covering is extended into a somewhat taut position relative to the conical-shaped support member 12. A decorative edge 24 may be placed around the periphery of the conical-shaped support member.

Figure 2:
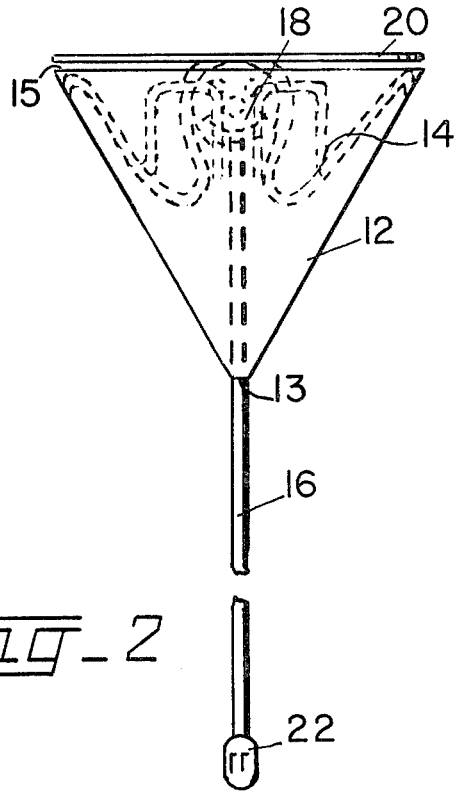
FIG. 2 is a front view of a hand-controlled puppet in a closed position.

FIG. 2 shows the hand-controlled puppet in a closed position. In the closed position, the elongated rod 16 is withdrawn from the conical-shaped support member 12 which draws the simulated head 18 and the bilaminar covering 14 into the hollowed-out central area. The planar-shaped member which is affixed to the top of the head 18 acts as a cover when the puppet is fully drawn into the hollowed-out central area of the conical-shaped support member 12.

In operation, a user holds the conical-shaped support member 12 in one hand, and places the other hand on the elongated rod 16 to move the rod 16 in a vertical position to open and close the puppet. Specifically referring to FIG. 1, to close the puppet, the user would hold the conical-shaped support member 12 in one hand and move the elongated rod 16 with the other hand in a first vertical direction, that is, to move rod 16 such that the head 18 moves toward the first aperture 13 which draws the head 18 and the bilaminar covering 14 into the hollowed-out central area of the conical-shaped support member 12. Referring to FIG. 2, to open the puppet, the user would hold the conical-shaped support member 12 in one hand and move the elongated rod 16 in a second vertical direction such that the head 18 moves away from the first aperture 13, to transport the head 18 and the bilaminar covering 14 from the hollowed-out central area into the opened position.

Figure 3:
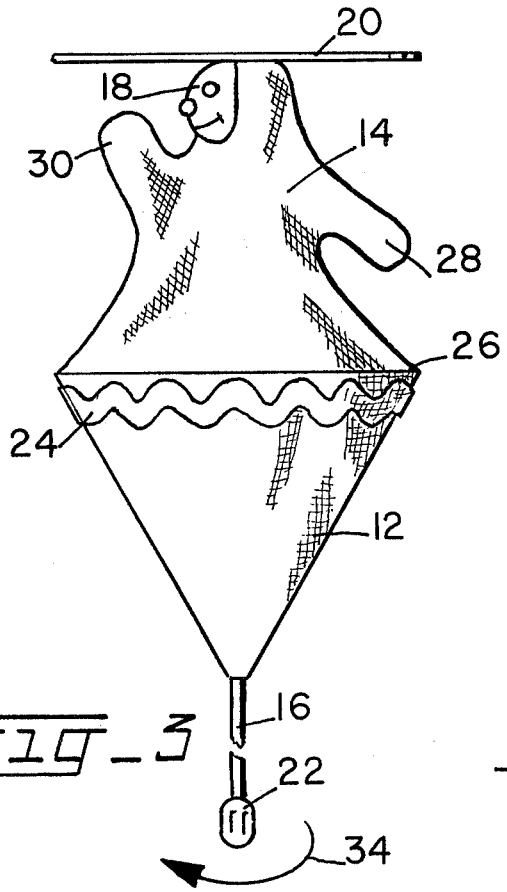
FIG. 3 is a front view of a hand-controlled puppet wherein the elongated rod has been rotated 90 degrees clockwise causing the left arm to raise and the right arm to be lowered.

FIG. 3 shows the relationship between the various elements when the puppet is animated. Specifically, FIG. 3 depicts the action of the puppet in response to the elongated rod 16 being moved in a clockwise direction, as shown by Arrow 34. Rotation of the elongated rod 16 causes the head 18 to rotate in the same direction as the rod 16. The bilaminar covering is twisted between the rotating action of the head 18, the portion of the bilaminar covering attached to elongated rod 16 to simulate a backbone and the bottom portion of the bilaminar covering 14 attached to the base of the conical-shaped support member 12. The twisting effect caused by the relative rotation of the bilaminar covering causes the left opposing arm 30 to raise toward the head and the right opposing arm 28 to move away from the head and toward the base of the conical-shaped support member 12.

Figure 4:
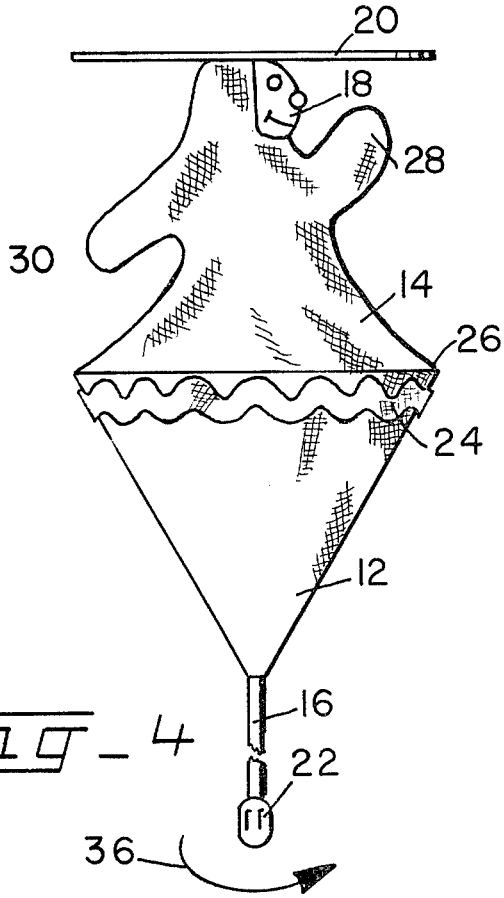
FIG. 4 is a front view of the hand-controlled puppet wherein the elongated rod has been rotated 90 degrees counterclockwise causing the right arm to be raised and the left arm to be lowered.

FIG. 4 shows the relationship between elongated rod 16 when the rod is rotated in a counterclockwise direction, as shown by Arrow 36, the bilaminar covering 14 and the head 18. In response to the counterclockwise rotation of elongated rod 16, the left opposing arm 30 moves away from the head 18 and toward the base of conical-shaped support member 12 while right opposing arm 28 moves toward the head 18.

In use, the puppet is manipulated by movement of elongated rod 16 in any vertical direction from a completely open to a completely closed position to cause the puppet to be drawn into and transported from the hollowed-out central area of the conical-shaped support member 12. Likewise, rotation of the rod 16 can be accomplished in the vertical position to cause relative movement of the arms 28 and 30 to show a lifelike response to movement of the puppet.

In FIGS. 3 and 4, it is apparent that the rotation of the rod 16 in either the clockwise or counterclockwise direction is limited by the tautness, the length of the bilaminar covering and other such factors. In the preferred embodiment, the elongated rod 16 could be rotated 90 degrees in either clockwise or counterclockwise direction as measured from the front position of the head as shown in FIG. 1.

The preferred embodiment disclosed in FIG. 1 has the height of the bilaminar covering and head assembly approximately equal to the axial height of the conical-shaped support member 12. In order to provide an operable hand-controlled puppet, it is necessary that the length of the elongated rod 16 must be greater than approximately two (2) times the actual height of the conical-shaped support member 12 in order to provide sufficient length to manipulate the puppet in a desired manner.

Figure 5:
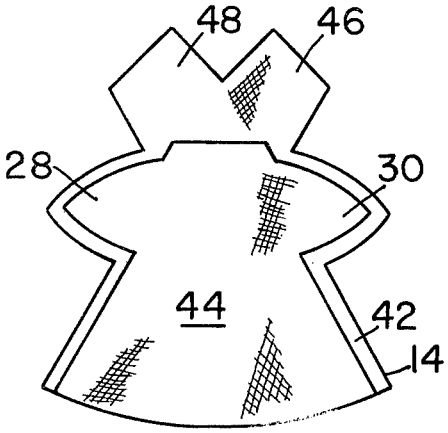
FIG. 5 is a front view showing one embodiment of the bilaminar covering having a front and back portion.

FIG. 5 shows the bilaminar covering 14 having back piece 42 which has a pair of opposed extending arms formed therein and a front piece 44, which likewise has a pair of opposed extending arms formed therein. The pair of opposed extending arms is generally illustrated as FIGS. 28 and 30 on the front piece 44. Of importance is that the separate front piece 44 is formed to have a slightly smaller size geometrically than the back piece 42. In fabrication of the bilaminar covering 14, the following method was found to be acceptable.

Figure 10:
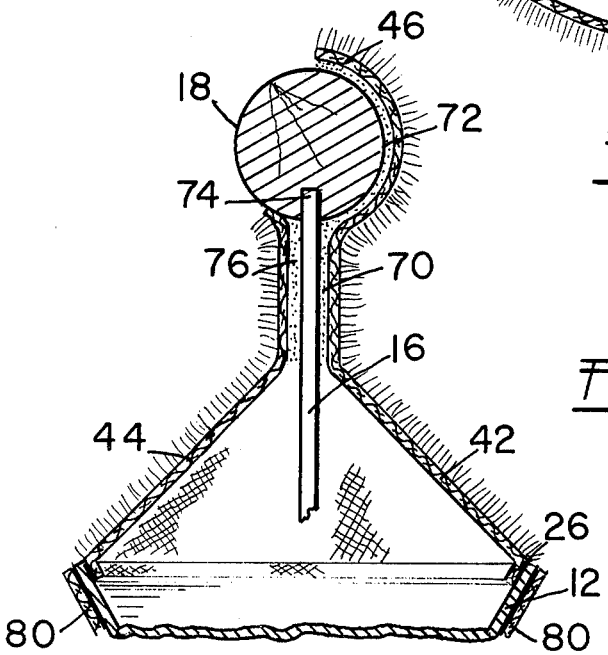
FIG. 10 is a front plan cross-sectional view showing the relationship between the bilaminar covering, the back and front portions thereof, and the simulated head and elongated rod assembly.

The back piece 42 and the front piece 44 are positioned, as illustrated in FIG. 5. If the animated puppet is to be an animal, such as, for example, a bear having a fur-like exterior, a fur-like fabric is used to form the bilaminar covering 14. In such event, the fur-like surfaces are positioned toward each other such that the smooth surfaces are in an opposed parallel relationship. In addition, the back portion 42 has elongated top portions extending from the back thereof, which are shown as elements 46 and 48. The extended top portion of the back piece 42 is ultimately used to enclose the simulated head, as illustrated in FIG. 10.

Figure 6:
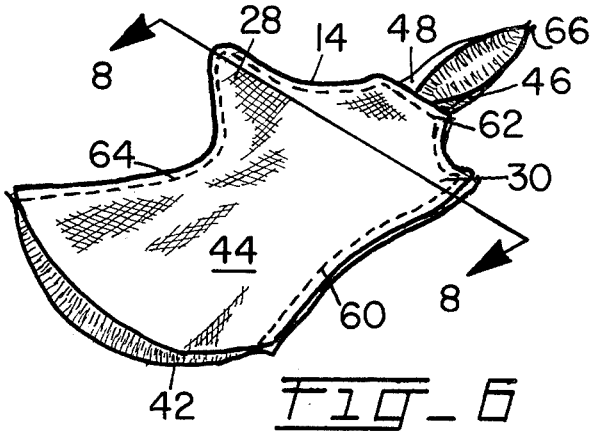
FIG. 6 is an isometric view showing a back and front piece sewn together to form the bilaminar covering.

After the bilaminar covering 14, comprising the back piece 42 and front piece 44, are prepared and assembled, as illustrated in FIG. 5, the back piece 42 and the front piece 44 are then sewn together, as illustrated in FIG. 6. The sewing occurs along the outer edges of the bilaminar covering which defines the opposed extending arms 28 and 30, as shown by seams 64 and 60 respectively. Thereafter, the tops of the elongated back portions 46 and 48 are joined together and sewn at the top, as illustrated by seam 66.

The last sewing step is to stitch each of the elongated elements 46 and 48 to the top of the front piece 44 shown by seam 62. This results in a small opening between the back piece 42 and front piece 44 to receive the head and elongated rod assembly.

Figure 7:
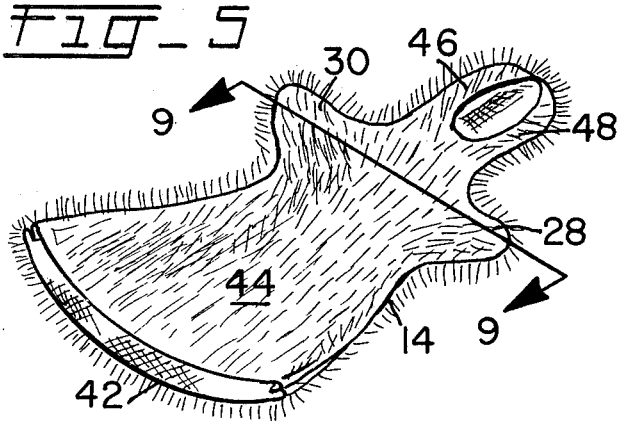
FIG. 7 is an isometric view wherein the sewn bilaminar covering of FIG. 6 is reversed and adapted to be mounted on the head and elongated rod assembly.

Upon the completion of the sewing, the bilaminar covering 14 is then reversed and is illustrated in a reversed position in FIG. 7. When reversed, the opposed extending arms 28 and 30 are shown in the same positions as they ultimately appear in FIGS. 1, 3 and 4.

In the preferred embodiment, the puppet is formed to depict a bear, so a fur-like exterior is shown on the bilaminar covering 14. By sewing the elongated back portions 46 and 48 together, an annular shape is formed therein which is adapted to slip over and permit the front of the simulated head 18 to extend therethrough. A face or other appropriate feature is then affixed to or painted on the surface of the head 18 which protrudes through the opening defined by the elongated back portions 46 and 48.

Figure 8:
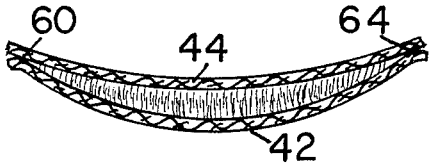
FIG. 8 is a sectional view of the sewn bilaminar covering taken along Section Lines 8—8 of FIG. 6.
Figure 9:
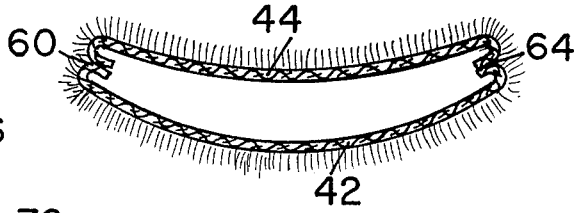
FIG. 9 is a sectional view of the bilaminar covering taken along Section Lines 9—9 of FIG. 7.

FIG. 8 is a section taken along the sewn bilaminar covering 14, as illustrated in FIG. 6, before it is reversed to place the fur-like exterior on the outside of the bilaminar covering 14. In FIG. 8, the back portion 42 and the front portion 44 are shown when sewn along seams 60 and 64 and result in a slight positive bias which urges the bilaminar covering 14 into an arcuate shape with the opposed arms 28 and 30 bending slightly toward the front 44. This condition is likewise illustrated in FIGS. 6 and 7. The bilaminar covering 14, illustrated in FIG. 6, when reversed, as illustrated in FIG. 7, results in a cross section as illustrated in FIG. 9. The seams 60 and 64 are bent inwardly and result in a completely fur-like exterior being shown without exposing any of the seams. Similarly, since the front portion 44 is slightly smaller in size than the back portion 42, a positive bias continues to urge the bilaminar covering 14 into an arcuate shape with the opposed extending arms 28 and 30 bending slightly toward the front. As illustrated in FIG. 9, the smooth interior surface of the back portion 42 and the front surface 44 are smooth and define a small opening therebetween. This opening is of sufficient width so that an elongated rod 16 can easily be passed therethrough to permit the assembly of a head, an elongated rod and bilaminar covering assembly, which ultimately are mounted on the conical-shaped support member 12.

FIG. 10 shows the technique for fabricating the assembled puppet. The head 18 and the elongated rod 16 are first formed into a head and rod assembly and that assembly is then inserted into the sewn reversed bilaminar covering 14. An adhesive is then applied between the elongated back portion 46 of the back piece 42 to adhere the bilaminar covering 14 secured to the back of the head 18. The adhesive is shown as 72 in the area of the head. Likewise, the elongated rod 16 is joined to the head 18 by means of an adhesive 74 to insure a tight fit therebetween. In addition, adhesive is placed between the interior of the back 42, front 44 and the rod 16, which adhesive is depicted by adhesive locations 70 and 76 respectively. The adhesives 70 and 76 together with the back portion 42 and front piece 44, the bilaminar covering 14, and the elongated rod 16 form a simulated back bone construction which cooperates with the bilaminar covering 14 to afford movements of relative rotation between the bilaminar covering 14, the elongated rod 16 and the conical-shaped base member 12.

The effect of the above relationship is that rotation of the elongated rod 16 in either a clockwise direction, as illustrated in FIG. 3, or a counterclockwise direction as illustrated in FIG. 4, is limited in degree of rotation by the physical relationship as to the length of fabric between the adhered portions and the unadhered portions of the bilaminar covering 14 which is attached to the conical shape support base 12, the length of the fabric forming the bilaminar covering 14 and other such factors. Of importance, is the fact that relative rotation does occur between the elongated rod 16 and head 18 assembly. Rotation of the head 18 and rod 16 assembly causes a portion of the bilaminar covering 14, which is adhered to the rod 16, to rotate in the same direction as rotation of the rod. The head rotation causes the extended top portion of the back piece 44 to rotate therewith relative to the fixed portion of the bottom part of the bilaminar covering 14 which is attached to the conical-shaped support member 12. As illustrated in FIGS. 3 and 4, the degree of rotation of the head 18 in response to the rotation of the elongated rod 16 will produce a small or large movement of the opposed extending arms 28 and 30 in proportion to the degree of rotation.

In the preferred embodiment, the hand-controlled animated puppet is in the form of a bear. This occurs by painting a bear face on the front of the portion of head 18 which extends beyond the extended back portions 46 and 48 of the bilaminar covering 14. By use of a fur-like exterior, a bear puppet is constructed. Various movements of the rod, including a first vertical direction or second vertical direction and/or movement of the rod in clockwise or counterclockwise direction, results in a hand-controlled puppet being an animated bear, wherein the arm movement is caused primarily by the simulated backbone construction arrangement as described in connection with FIG. 10. Also, by rocking the elongated rod 16, the head 18 moves to cause lifelike movements of the puppet.

In the preferred embodiment, adhesives 70, 72 and 76 are all continuous, that is, the adhesives are applied to form a continuous adhesive between the critical parts to afford a tight adhesive relationship between the bilaminar covering 14, the simulated head 18, and the elongated rod 16.

In the preferred embodiment, the bottom of the bilaminar covering 14 is sewn to the base of the conical-shaped support member as shown by seam 26. Also, in order to afford a hand-controlled puppet which has a cloth-like appearance, a smooth fabric such as a cloth 80 can be adhered to the exterior of the thin wall of the conical-shaped support member 12.

It is envisioned that the bilaminar covering 14 could be formed of a number of materials depending on the type of hand-controlled puppet which is desired. It is envisioned that the bilaminar covering 14 could be formed of a smooth type material which has a smooth texture, both in the interior surface and the exterior surface of the puppet.

In fabricating the hand-controlled puppet of the present invention, the method of assembly can be briefly described in the following manner:

The method of fabricating a hand-controlled puppet comprises, and not necessarily in the sequence set forth below, the steps of:

forming a conical-shaped member to produce a hollowed-out central area therein with a first aperture at the tip end and a second aperture at the base end of the conical-shaped support member with the apertures in axial alignment with the conical-shaped support member;

placing an elongated rod within the hollowed-out central area of the conical-shaped support member which is adapted to pass through both of the axially aligned first and second apertures;

affixing a simulated head to the end of the elongated rod adjacent the base of the conical-shaped support member;

affixing a bilaminar covering having an elongated back portion and a pair of opposing arms and a bottom portion to the head and elongated rod assembly and to the base of the conical-shaped support member to enclose the second aperture;

adhering the elongated back portion of the bilaminar covering to the back of the head and adhering the interior of the back and front of the bilaminar covering to the elongated rod to form a simulated backbone relationship; and attaching the bottom portion of the bilaminar covering to the base end of the conical-shaped support member to form the hand-controlled puppet.

What is claimed is:

1. A hand-controlled puppet comprising a conical-shaped support member having a hollowed-out central area which terminates in a first aperture at the tip end of the conical-shaped support member and which terminates in a second aperture at the base end of the conical-shaped support member, each aperture being in axial alignment with the axis of the conical-shaped support member and with the center of the other;

an elongated rod positioned in the hollowed-out central area of the conical-shaped support member and extending axially therethrough and past and beyond the first aperture at the tip end of the conical-shaped support member and past and beyond the second aperture at the base of the conical-shaped support member, said elongated rod being adapted to be moved vertically relative to said support member along the axis of the conical-shaped support member and through the first aperture and second aperture and being adapted to be rotated relative to said support member about said axis in at least one of a clockwise and counterclockwise direction in any vertical position;

a simulated head mounted on the end of the elongated rod adjacent to the second aperture;

a bilaminar covering having a back and a front positioned adjacent said second aperture and adapted to have the portion of the elongated rod extending past and beyond the base located between the back and front of the bilaminar covering, said bilaminar covering having an elongated top portion extending from the back thereof which is positioned around and attached to the back portion of the head which is affixed to the end of the elongated rod adjacent the second aperture, a pair of opposed extending arms and a bottom portion which is affixed to the base of the conical-shaped support member to enclose said second aperture, said bilaminar covering having a positive bias which urges the bilaminar covering into an arcuate shape with the opposed arms bending slightly toward the front; and an adhesive joining the elongated top portion of the back member of the bilaminar covering to the back portion of the head and joining a portion of the interior of the back and front of the bilaminar covering to that portion of the elongated rod extending between the back and front of the bilaminar covering to form a simulated backbone and to limit the rotation of the elongated rod relative to said bilaminar covering in both the clockwise and counterclockwise direction, said elongated rod, head and bilaminar covering affixed thereto being adapted to move in a first vertical direction toward the first aperture to draw the head and bilaminar covering to the interior of the hollowed-out central area of the conical-shaped support member and to move in a second vertical direction toward the second aperture to transport the head and bilaminar covering out of the hollowed-out central area enabling the head and rod to extend the bilaminar covering between the head and base; said elongated rod being adapted to be rotated in at least one of a clockwise and counterclockwise direction relative to the conical-shaped support member to rotate the top and back of the bilaminar covering in the direction of the rotation of the rod relative to the bottom of the bilaminar covering affixed to the base of the conical-shaped support member to cause one of the opposed extending arms to move in an upward direction toward the head and the other opposed extending arm to move in a downward direction toward the base to enable a user to hold the conical-shaped support member in one hand and to move the elongated rod with the other hand in the first vertical direction to draw the head and bilaminar covering into the hollowed-out central area of the conical-shaped support member and in the second vertical direction to transport the head and the bilaminar covering from the hollowed-out central area and to rotate the elongated rod through the limited rotation in at least one of a clockwise and counterclockwise direction causing movement of the opposed extending arms relative to the head.

2. The hand-controlled puppet of claim 1 wherein the bilaminar covering further comprises a back piece having a pair of opposed extending arm portions and a separate front piece having a slightly smaller size than the back piece and having a pair of opposed extending arm portions which are positioned in an opposed parallel relationship with the opposed extending arm portions on the back piece, said back piece and front piece being joined together around the periphery thereof to produce a positive bias causing the pair of opposed extending arm to extend into an arcuate shape with the opposed extending arms bending slightly toward the front member.

3. The puppet of claim 2 further comprising a planar-shaped member having a geometrical dimension which is substantially equal to the dimension of the second aperture in the base of the conical-shaped support member, said planar-shaped member being affixed to the top of the head such that when the head and bilaminar covering are drawn into the hollowed-out central area of the conical-shaped support member, the planar-shaped member acts as a cover when the head is fully drawn into the hollowed-out central area and when the head and bilaminar covering are transported from the hollowed-out central area the head and the bilaminar covering are positioned between the planar-shaped member and base.

4. The puppet of claim 3 wherein the bilaminar covering has a relatively smooth interior surface and a fur-like exterior surface.

5. The puppet of claim 3 wherein the extended portion of the back member is affixed to and encloses approximately one-half of the head member and wherein the adhesive extends therefrom to that portion of the back and front adjacent the elongated rod which is affixed to the elongated rod by the adhesive.

6. The puppet of claim 5 wherein the head and bilaminar covering are selected of material and of design to simulate an animated bear which, when the extended rod is rotated to a maximum of approximately 90 degrees clockwise and counterclockwise as measured from the center position of the head member, causes one of the opposed extended arms to extend in an upward position and the other opposed extended arm to extend in a downward position in response to the relative rotation between the head, extended rod attached to the bilaminar covering and the bottom edge of the bilaminar covering attached to the base of the conical-shaped support member.

7. The puppet of claim 6 wherein the conical-shaped support member includes a cloth covering affixed to the exterior of the conical-shaped support member to define a decorative cloth-like exterior.

8. The puppet of claim 5 wherein the length of the elongated rod is greater than approximately two times the axial height of the conical-shaped support member and the length of the bilaminar covering is approximately equal to the axial height of the conical-shaped support member.

9. The puppet of claim 8 wherein the end of the elongated rod extending through the first aperture terminates in an annular-shaped ball member.

10. The puppet of claim 9 wherein the bottom edge of the bilaminar covering is sewn to the edge of the base of the conical-shaped support member.

11. The puppet of claim 4 wherein the bilaminar covering back and front portions are sewn along the area including the opposed extending arms such that when the sewn bilaminar covering is reversed with the smooth area in the interior thereof and the fur-like surface on the exterior thereof the bilaminar covering has a slight archward shape which causes the arms to extend toward each other.

12. The puppet of claim 3 wherein the bilaminar covering is formed of a smooth type material which has a smooth texture both in the interior surface and the exterior surface of the puppet.

13. The puppet of claim 12 wherein the center back portion of the back of the bilaminar covering and the interior of the back and front of the bilaminar covering adjacent the rod and head are joined together by adhesive from the portion of the top of the head down and into the area between the back and front of the bilaminar covering.

14. The method of fabricating a hand-controlled puppet comprising the steps of forming a conical-shaped member to produce a hollowed-out central area therein with a first aperture at the tip end and a second aperture at the base end of the conical-shaped support member with the apertures in axial alignment with the conical-shaped support member;

placing an elongated rod within the hollowed-out central area of the conical-shaped support member which is adapted to simultaneously pass through both of the axially aligned first and second apertures;

affixing a simulated head to the end of the elongated rod adjacent the base of the conical-shaped support member;

forming a bilaminar covering having a front portion, a relatively elongated back portion, a pair of opposing arms with a positive bias causing said arms to curve toward said front portion and a bottom portion;

affixing said bilaminar covering to the head and elongated rod assembly and to the base of the conical-shaped support member to enclose the second aperture, said affixing being performed by adhering the elongated back portion of the bilaminar covering to the back of the head and adhering the interior of the back and front of the bilaminar covering to the elongated rod to form a simulated backbone relationship; and attaching the bottom portion of the bilaminar covering to the base end of the conical-shaped support member to form the hand-controlled puppet.

15. The method of claim 14 further comprising the step of forming the bilaminar covering by sewing a back portion and a smaller front portion together along the edge thereof to form a positive bias which urges the pair of opposed arms into an arcuate shape toward the front of the bilaminar covering.

* * * * *